US007699488B2

(12) United States Patent
Drees

(10) Patent No.: US 7,699,488 B2
(45) Date of Patent: Apr. 20, 2010

(54) BUILT-IN LIGHT

(75) Inventor: Frank Drees, Plettenberg (DE)

(73) Assignee: Trilux GmbH & Co. KG, Arnsberg (DE)

( * ) Notice: Subject to any disclaimer, the term of this patent is extended or adjusted under 35 U.S.C. 154(b) by 859 days.

(21) Appl. No.: 10/597,322

(22) PCT Filed: Jan. 28, 2005

(86) PCT No.: PCT/DE2005/000129

§ 371 (c)(1),
(2), (4) Date: Jul. 20, 2006

(87) PCT Pub. No.: WO2005/073628

PCT Pub. Date: Aug. 11, 2005

(65) Prior Publication Data

US 2008/0239729 A1 Oct. 2, 2008

(30) Foreign Application Priority Data

Jan. 30, 2004 (DE) ..... 20 2004 001 479 U

(51) Int. Cl.
*F21S 8/00* (2006.01)

(52) U.S. Cl. ..... 362/147; 362/148; 362/150; 362/364; 362/365; 362/404

(58) Field of Classification Search ..... 362/147, 362/148, 150, 364, 365, 366, 404; 248/317, 248/339, 340, 342, 343, 344
See application file for complete search history.

(56) References Cited

U.S. PATENT DOCUMENTS

| | | | | |
|---|---|---|---|---|
| 5,909,955 | A * | 6/1999 | Roorda | 362/368 |
| 6,283,430 | B1 | 9/2001 | Schubert et al. | |
| 6,286,265 | B1 | 9/2001 | Rinderer | |
| 7,192,167 | B1 * | 3/2007 | Kuo | 362/362 |

FOREIGN PATENT DOCUMENTS

| | | | |
|---|---|---|---|
| DE | 88 04 149 | U1 | 7/1988 |
| DE | 90 04 386.3 | U1 | 8/1990 |
| DE | 43 12 661 | A1 | 10/1994 |
| DE | 295 09 094 | U1 | 11/1995 |
| DE | 100 12 968 | A1 | 10/2001 |
| DE | 100 47 407 | A1 | 1/2002 |
| EP | 1 336 696 | A1 | 8/2003 |

* cited by examiner

*Primary Examiner*—Jong-Suk (James) Lee
*Assistant Examiner*—Mark Tsidulko
(74) *Attorney, Agent, or Firm*—Panitch Schwarze Belisario & Nadel LLP

(57) ABSTRACT

In order further to develop a built-in light comprising a frame 1 which can be mounted to a ceiling, a retaining hoop 2 which can be fixed to the top side of the frame, a reflector 4 which can be connected to the frame 1 and a fitting carrier 3 which can also be connected to the frame 1 in such a way that it can be more easily assembled, it is proposed that the retaining hoop 2 is provided with lateral guide surfaces **2*d* for guiding the fitting carrier 3 and support surfaces 2*e* engaging thereunder for draw-like receiving the fitting carrier 3 and that there are provided latching means for connecting the fitting carrier 3 to the retaining hoop 2**.

2 Claims, 3 Drawing Sheets

BUILT-IN LIGHT

CROSS-REFERENCE TO RELATED APPLICATIONS

This application is the US National Stage of International Application No. PCT/DE 2005/000129, filed on Jan. 28, 2005 and claims the benefit thereof. The International Application claims the benefits of German application No. 20 2004 001 479.3 filed on Jan. 30, 2004, both of the applications are incorporated by reference herein in their entirety.

BACKGROUND OF THE INVENTION

The invention concerns a built-in light comprising a frame which can be mounted to a ceiling and having a central opening, a retaining hoop which can be fixed to the top side of the frame and which spans bridge-like over the central opening, a reflector which can be connected to the frame, a fitting carrier which can also be connected to the frame and latching means for connecting the fitting carrier to the retaining hoop.

By way of example German utility model No G 88 04 149 discloses a square built-in light of that kind, which generally nowadays is also referred to as a 'down light'. In the course of assembly, the frame is fitted into a corresponding receiving opening in the ceiling and latched to the ceiling with fixing means which engage behind the rear side of the opening in the ceiling. In that situation the frame which is usually in the form of a sturdy die cast frame pulls irregularities in the ceiling straight so that the frame is caused to bear against the ceiling without a gap. Mounted on the frame at the top side thereof is the retaining hoop which preferably comprises a stamped sheet metal part which is suitably bent in a U-shape. A reflector and a fitting carrier can be releasably fixed to that retaining hoop. The fitting carrier receives the fittings for the lamp means which in the installation position project laterally through the reflector into the interior of the internal space of the reflector. For cost reasons the reflector is nowadays preferably made from a very thin aluminium; in contrast, for stability reasons, the retaining hoop usually comprises steel sheet. Further built-in lights of that kind are known from DE 100 47 407 and DE 295 09 094. EP 1 336 996 also discloses a hanging light. A built-in light of another kind is known from DE 43 12 661.

In general terms the problem arises in built-in lamps of that kind that the entire built-in lamp, that is to say the reflector, has to be installed during electrical system installation in the phase of erecting the carcass shell of the building. As still further stages in construction usually have to be performed after the electrical system installation phase, the reflector from time to time gets dirty to a considerable extent or is scratched during the further building phases. Prior to final purchase the reflector either has to be separately cleaned or even replaced. In particular in the ease of above-mentioned DE 100 47 407 a rail connecting the fitting carrier to the frame first has to be screwed to the top side of the frame. That is complicated and time-consuming.

It is admittedly known for the reflector to be fixed releasably to the retaining hoop, but then assembly of the unit carrier is also quite complicated and expensive.

BRIEF SUMMARY OF THE INVENTION

Accordingly the object of the present invention is to develop a built-in light of the general kind set forth, in such a way that it is of an inexpensive structure and in addition it can be fitted more easily.

In accordance with the invention, in a built-in light of the kind set forth in the opening part of this specification, that object is attained in that the retaining hoop includes tongues with lateral guide surfaces for guiding the fitting carrier and support surfaces engaging thereunder for draw-like receiving the fitting carrier on the retaining hoop and that the fitting carrier has laterally extending slide bars which in the installation position engage into the tongues.

The draw-like receiving configuration on the frame for receiving the fitting carrier provides that the fitting carrier can be particularly easily fixed to the frame. The fitting carrier only has to be pushed into the retaining hoop, in a direction of pushing movement which is substantially parallel to the surface of the horizontally extending part of the retaining hoop, until the latching means come into latching engagement. For that purpose provided on the retaining hoop for receiving the fitting carrier are support surfaces which engage therebeneath and lateral guide surfaces. Latching means are further provided between the fitting carrier and the retaining hoop.

Preferably the latching means include latching tongues which are provided on the fitting carrier and which in the installation position engage into undercut configurations correspondingly provided on the retaining hoop. By way of example, the undercut configurations can be in the form of simple openings on the fitting carrier.

The desired draw-like receiving means for the fitting carrier on the retaining hoop is particularly simple to produce if the fitting carrier has suitably bent-over tongues which at the same time perform the lateral guide function and the contact support function; that can be achieved for example by the tongues being bent over in an angular configuration. On those angle portions, a vertical portion functions as a lateral guide element and a horizontal portion adjoining the vertical portion serves as a support surface for the fitting carrier. Those angle configurations can be provided by being simply stamped out and bent over on the retaining hoop. Preferably those tongues are provided at both sides at the longitudinal edges of the horizontal portion of the retaining hoop in order to ensure a stable hold between the retaining hoop and the device carrier.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
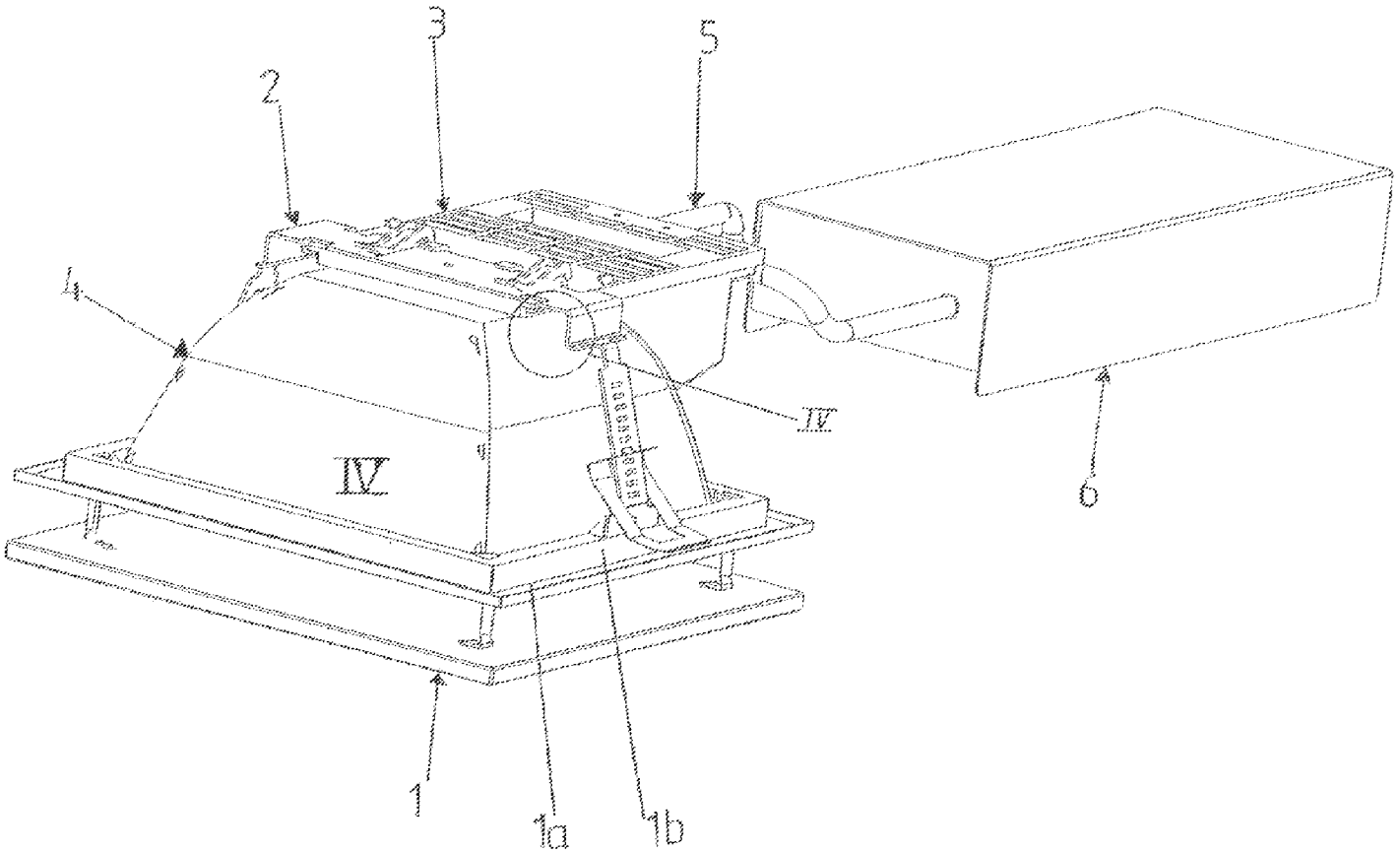
FIG. 1 shows a perspective view of the square built-in light.

Referring to the Figures the square built-in light substantially comprises a square frame 1, a retaining hoop 2 which is screwed at the top side to the frame 1, a fitting carrier 3 which can be connected to a horizontal portion of the retaining hoop 2 and a reflector 4 which can be releasably fixed to the underside of the horizontal portion of the retaining hoop.

Separately from the built-in light, it is connected by means of a cable 5 to power supply unit boxes 6 which can be provided in the ceiling. The power supply unit box 6 serves to receive electronic or electrical power supply units for operation of the built-in light.

The frame 1 is in the form of a die cast frame and has a horizontally extending contact flange 1*a* for bearing against an opening in a ceiling, for example in a plasterboard panel. Adjoining the contact flange 1*a* in inwardly displaced relationship is a step 1*b* which extends vertically in the installation position and which bears against the inside edge in the opening in the ceiling. Screwed on the top side of the frame 1 is the U-shaped retaining hoop 2 which extends in a bridge-like configuration over the central opening in the frame. The retaining hoop 2 has two lateral vertical legs 2*a* and a horizontal leg 2*b* connecting the vertical legs 2*a*. That horizontal leg 2*b* represents the fixing plane for the fitting carrier 3 and the reflector 4.

The reflector 4 is releasably clipped to the underside of the retaining hoop 2. The fitting carrier 3 is shown in FIG. 1 in its assembly position of being pushed on to the retaining hoop 2.

Figure 2:
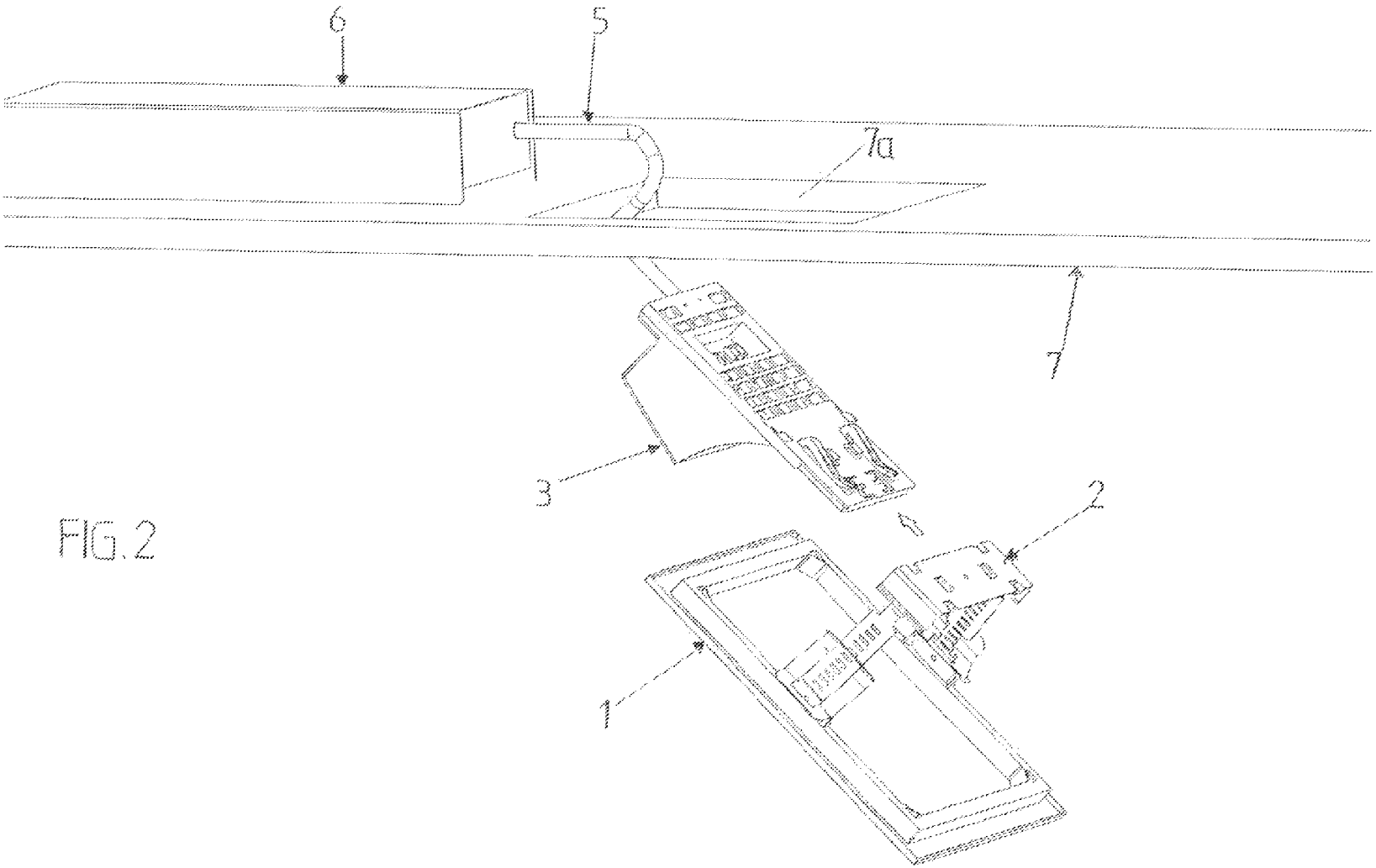
FIG. 2 shows a perspective view of the built-in light to illustrate assembly in a suspended ceiling.

FIG. 2 shows the built-in light upon installation. The power supply unit box 6 is mounted on the top side of a plasterboard panel 1 or simply laid thereon. The plasterboard panel 1 has a square opening 7*a*, into which the frame 1 can be exactly inserted. In the phase involving production of the carcass shell of the building the fitting carrier 3 is merely pushed on to the retaining hoop 2 of the built-in light in a draw-like manner, that is to say by implementing a substantially horizontal pushing movement, until there is latching engagement of the latching means on the retaining hoop. In that pre-assembly position, the frame 1 is fitted into the opening and screwed therein; insertion of the reflector 4 and the lamp means is only effected in the last building phases in which damage to the reflector can no longer occur.

Figure 3:
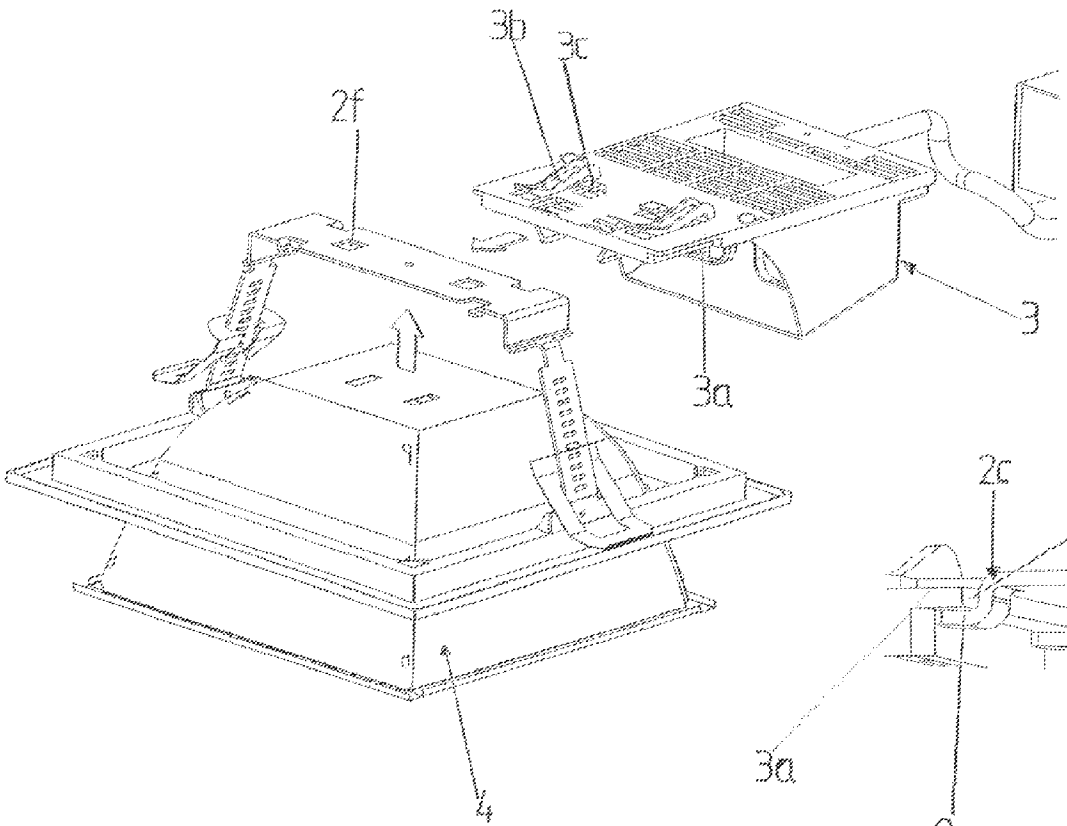
FIG. 3 shows a perspective view to illustrate assembly of the built-in light.
Figure 4:
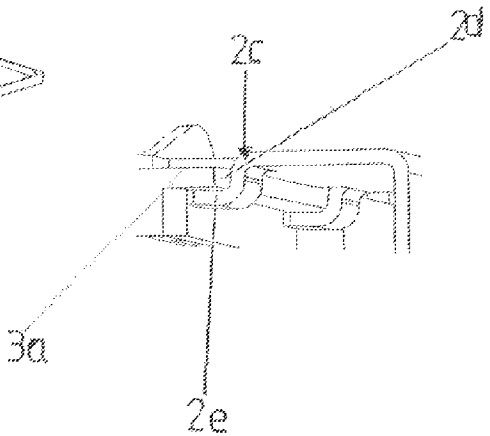
FIG. 4 shows a view on an enlarged scale of the detail IV in FIG. 1.

The connection technology as between the fitting carrier 3 and the retaining hoop 2 can be particularly clearly seen from FIGS. 3 and 4. The retaining hoop 2 has four of the tongues 2*c* shown on an enlarged scale in FIG. 4. The tongues 2*c* are produced by stamping at the longitudinal edges in the region at the ends of the horizontal leg 2*b*. Each tongue 2*c* has a lateral guide surface 2*d* projecting downwardly out of the plane of the horizontal leg 2*b* and an adjoining support surface 2*e* which extends in downwardly displaced relationship parallel to the horizontal leg 2*b*. The lateral guide surfaces 2*d* and support surfaces 2*e* are produced by simply bending over the tongues 2*c*. The total of four support surfaces 2*e* of the tongues 2*c* serve to receive the slide bars 3*a* formed on the fitting carrier at the outside thereof; the four support surfaces 2*e* accordingly define a support plane. At the same time the outer edges of those slide bars 3*a* bear laterally against the guide surfaces 2*d*. In the installation operation therefore the fitting carrier 3 only has to be connected to the retaining hoop 2 by performing a horizontal thrust force.

The latching tongues 3*b* provided on the fitting carrier 3 at the top side thereof serve for fixing in the assembled position. In the installation position they latch into four square openings 2*f* in the horizontal leg 2*b* of the retaining hoop 2. In order for the fitting carrier 3 to be particularly well fixed to the retaining hoop 2 in the installation position, two upwardly projecting supports 3*c* are also formed on the fitting carrier between the retaining tongues 3*b*, and in the installation position clamp the retaining hoop 2 between them and the top side of the fitting carrier 3. The fitting carrier 3 is preferably injection moulded in the form of a plastic component and preferably comprises thermoplastic materials, in particular PC, ABS, PA, PBT, POM and blends thereof. Fittings (not shown in greater detail) are arranged in the fitting carrier 3 for receiving the lamp means, which in the installation position project through an opening in the reflector 4 into the interior of the reflector 4.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A built-in light comprising:

A frame (1) mounted to a ceiling and having a central opening;

A retaining hoop (2) fixed to the top side of the frame and the retaining hoop spans bridge-like over the central opening;

A light reflector (4) connected to the frame (1) and a fitting carrier (3) connected to the frame (1);

wherein there are provided latching means for connecting the fitting carrier (3) to the retaining hoop (2), the latching means characterized in that the retaining hoop (2) includes tongues (2*c*) with lateral guide surfaces (2*d*) for guiding the fitting carrier (3) and support surfaces (2*e*) engaging thereunder for drawer-like receiving the fitting carrier (3) on the retaining hoop (2) and that the fitting carrier (3) has laterally extending slide bars (3*a*) which in installation position engage into the tongues (2*c*) of the retaining hoop (2), wherein the latching means further characterized in that the fitting carrier (3) has latching tongues (3*b*) which in the installation position engage behind corresponding undercut configurations on the retaining hoop (2).

2. A built-in light according to claim 1, characterized in that the fitting carrier (3) has supports (3*c*) which in the installation position embrace the retaining hoop (2).

* * * * *